US007160337B2

(12) United States Patent
Williams et al.

(10) Patent No.: US 7,160,337 B2
(45) Date of Patent: Jan. 9, 2007

(54) TRANSPARENT, VEGETABLE-BASED, SUBSTANTIALLY HYDROCARBON-FREE CANDLE ARTICLE

(75) Inventors: Virgil A. G. Williams, Leonardo, NJ (US); Craig M. Stumpf, Branchburg, NJ (US)

(73) Assignee: International Flavors & Fragrances Inc., New York, NY (US)

( * ) Notice: Subject to any disclaimer, the term of this patent is extended or adjusted under 35 U.S.C. 154(b) by 649 days.

(21) Appl. No.: 10/022,636

(22) Filed: Dec. 17, 2001

(65) Prior Publication Data

US 2003/0110682 A1 Jun. 19, 2003

(51) Int. Cl.
*C11C 5/00* (2006.01)

(52) U.S. Cl. ..... 44/275; 431/288

(58) Field of Classification Search ..... 44/275; 431/288

See application file for complete search history.

(56) References Cited

U.S. PATENT DOCUMENTS

| | | | | |
|---|---|---|---|---|
| 3,148,125 | A | 9/1964 | Caldwell et al. | |
| 3,645,707 | A | 2/1972 | Miller et al. | |
| 4,552,693 | A * | 11/1985 | Hussain et al. | 512/4 |
| 5,171,329 | A | 12/1992 | Lin | |
| 5,679,334 | A | 10/1997 | Semoff, I et al. | |
| 5,783,657 | A | 7/1998 | Pavlin, I et al. | |
| 5,879,694 | A | 3/1999 | Morrison et al. | |
| 5,998,570 | A * | 12/1999 | Pavlin et al. | 528/310 |
| 6,063,144 | A | 5/2000 | Calzada et al. | |
| 6,071,506 | A | 6/2000 | Semoff, II et al. | |
| 6,086,644 | A | 7/2000 | Nakatsu et al. | |
| 6,111,055 | A * | 8/2000 | Berger et al. | 528/310 |
| 6,214,063 | B1 | 4/2001 | DeStefano et al. | |
| 6,242,509 | B1 | 6/2001 | Berger, II et al. | |
| 6,255,356 | B1 | 7/2001 | Butler | |
| 6,258,920 | B1 | 7/2001 | Starner et al. | |
| 6,268,466 | B1 | 7/2001 | MacQueen et al. | |
| 6,294,162 | B1 | 9/2001 | Semoff, III et al. | |
| 6,309,715 | B1 | 10/2001 | Lindauer et al. | |
| 6,319,290 | B1 | 11/2001 | Kalweit et al. | |
| 6,503,077 | B1 * | 1/2003 | Orth et al. | 431/288 |
| 2001/0013195 | A1 | 8/2001 | Tao | |
| 2001/0029696 | A1 | 10/2001 | DeStefano, II et al. | |
| 2001/0031280 | A1 | 10/2001 | Ferrari | |
| 2001/0031438 | A1 | 10/2001 | Hannington et al. | |

FOREIGN PATENT DOCUMENTS

| | | | |
|---|---|---|---|
| EP | 606855 | A1 | 7/1994 |
| EP | 606856 | A1 | 7/1994 |
| WO | WO 00/73408 | A1 | 7/2000 |
| WO | WO 01/53376 | A1 | 7/2001 |

OTHER PUBLICATIONS

Ecowax™ Website Home Page, Technical Assistance Page, Distributor List Page, Using Ecowaxes Instruction Page and Ecowax Benefits Page, date unknown.

* cited by examiner

*Primary Examiner*—Cephia D. Toomer
(74) *Attorney, Agent, or Firm*—Joseph F. Leightner; Elizabeth M. Quick

(57) ABSTRACT

Described is a transparent syneresis-free candle which is substantially hydrocarbon-free, e.g., mineral oil-free and paraffin wax-free; substantially stearic acid-free and consistently-maintained functional compositional integrity on use thereof. The candle composition contains a gellant that is an ester-terminated polyamide or a tertiary amide-terminated polyamide, a non-hydrocarbon solvent which is a vegetable-derived fatty acid ester, and a system-compatible functional fragrance composition, an insect repellent composition and/or an air freshener composition. The candle can be a pillar candle which is free-standing or a container candle.

6 Claims, No Drawings

TRANSPARENT, VEGETABLE-BASED, SUBSTANTIALLY HYDROCARBON-FREE CANDLE ARTICLE

FIELD OF THE INVENTION

This invention relates to a transparent, substantially rigid gel, substantially hydrocarbon-free, substantially stearic acid-free, and syneresis-free, pillar or supported candle article comprising a vegetable-based solvent admixed with an ester-terminated, or tertiary amide-terminated polyamide resin. A system-compatible functional composition which is one or more of a perfume composition, an insect repellent composition and/or an air freshener composition is preferably added to the candle.

BACKGROUND OF THE INVENTION

Transparent pillar or supported candles which release fragrances on use and which are fabricated from materials other than paraffin wax are known in the prior art and are commercially desirable. Such candles fabricated using non-aqueous ester-terminated polyamide resins are disclosed in U.S. Pat. Nos. 6,111,055, 6,242,509 and 6,214,063; U.S. patent application Ser. No. 2001/0029696 published on Oct. 18, 2001, the U.S. Patents and patent application hereby incorporated by reference; and PCT Application WO 00/73408 A1. However, all of the aforementioned disclosures require the use of the hydrocarbon, "mineral oil" as a solvent therefor or as included as a substantial part of the solvent which is necessary for the operation of the candle.

In addition, candles which release fragrance on use and which contain vegetable-based materials such as soy derivatives for all or a substantial portion of their structures are also commercially desirable and are known in the prior art, for example, the candles disclosed in the ECOWAX™ website, by NGI, Inc., P.O. Box 528097, Chicago, Ill. 60652-8097, and in U.S. Pat. Nos. 6,063,144, 6,086,644, and U.S. Published Patent Application 2001/0013195 published on Aug. 16, 2001, these patents and application hereby incorporated by reference. However, the aforementioned prior art does not disclose or suggest, transparent substantially rigid gel candles having structures that include vegetable-based solvents that are substantially hydrocarbon-free and substantially stearic acid free.

It is well known to those having ordinary skill in the art that inclusion of hydrocarbons such as mineral oil and paraffin wax, as well as stearic acid, either as a structural component and/or as a solvent component gives rise to emission of non-desirable substances into the environment surrounding the candle on use thereof.

Accordingly, a need exists for a transparent, substantially hydrocarbon-free, substantially stearic acid-free and syneresis-free candle article which, on use, releases to the environment surrounding the candle, one or more system-compatible functional compositions and which has, for its structure, a vegetable-based solvent admixed with an environmentally-acceptable and useful resin such as an ester-terminated polyamide or a tertiary amide-terminated polyamide.

SUMMARY OF THE INVENTION

Our invention provides a transparent, substantially rigid gel, substantially hydrocarbon-free, substantially stearic acid-free, and syneresis-free pillar or supported candle article having, for its structure, a vegetable-based solvent admixed with an ester-terminated and/or a tertiary amide-terminated polyamide resin, and further admixed with the resin and solvent, a system-compatible functional composition which is one or more of a perfume composition, an insect repellent composition and/or an air freshener composition. In addition, our invention provides a process for making such a candle article.

More particularly, our invention provides a transparent, substantially hydrocarbon-free, substantially stearic acid-free, syneresis-free candle article having consistently-maintained functional composition integrity on use thereof comprising at least one substantially upright wick partially imbedded in a stiff, monophasic, thermally reversible composition consisting essentially of:

(a) from about 75% by weight of said candle up to about 99% by weight of said candle of a gellant-solvent-surfactant/additional solvent system consisting essentially of:

(i) from about 20% to about 70% by weight of said candle of a gellant which is, in the alternative or in combination (A) at least one ester-terminated polyamide; and/or (B) at least one tertiary amide-terminated polyamide;

(ii) from about 15% to about 60% by weight of said candle of a vegetable-based solvent which is, in the alternative or in combination: (A) at least one methyl ester of a vegetable-derived $C_{12}$–$C_{18}$ carboxylic acid and/or (B) at least one glyceryl ester of a vegetable-derived $C_{10}$ carboxylic acid and, optionally admixed therewith, an additional solvent which is, in the alternative or in combination dipropylene glycol and/or isopropyl myristate; and (iii) optionally, from about 3% up to about 20% by weight of said candle of at least one surfactant having a hydrophile/lipophile balance in the range of from about 3 up to about 7, which is, in the alternative or in combination, di(hydroxyethoxy)coconut amine, (hydroxy-triethoxy)coconut amine, (hydroxydiethoxy)coconut amine, N-(hydroxyethoxy)-N-(hydroxydiethoxy)coconut amine, diethylene glycol mono(nonylphenyl)ether, hydroxytriethoxydodecane and/or hydroxytriethoxytridecane;

(b) from about 1% to about 25% by weight of said candle of a system-compatible functional composition which is, in the alternative or in combination, (A) a perfume composition;(B) an insect repellent composition and/or (C) an air freshener composition; and (c) optionally, one or more additives which is, in the alternative or in combination an antioxidant, a stabilizer, a colorant and/or a flame retardant which additives do not compromise the transparency of the candle.

The term, "substantially stearic acid-free" is intended herein to mean that the concentration of stearic acid is less than 1% of the weight of the candle article of our invention; more preferably, less than 0.5% of the weight of the candle article of our invention and most preferably less than 0.1% of the weight of the candle article of our invention.

The term "substantially hydrocarbon-free" is intended herein to mean that the concentration of any hydrocarbon in the candle article of our invention, e.g. paraffin wax or mineral oil, is less than 1% of the weight of the candle article of our invention; more preferably, less than 0.5% of the weight of the candle article of our invention; and most preferably less than 0.1% of the weight of the candle article of our invention.

The term "system-compatible functional composition" is herein intended to mean functional compositions, for example fragrance compositions which, when made part of the gellant-solvent system do not compromise the transparency of the candle by causing haze or cloudiness, due to, for example, phase separation, or syneresis to occur as a result of the composition being admixed with the gellant-solvent system.

The term, "consistently-maintained functional composition integrity" is intended herein to mean that when the candle is in use, the proportions of the constituents and the chemical properties of the constituents of the functional composition, e.g. the fragrance composition that is evolved into the environment on use of the candle article of our invention are substantially identical to the proportions and chemical properties of the constituents originally present in the candle article and originally admixed with the gellant-solvent system.

The term "stiff" is herein intended to mean that the container candle or pillar candle of our invention is self-supporting and non-flowable at ambient temperatures or less and at ambient pressures, e.g. at temperatures of <35° C. and at pressures of about 1 atmosphere absolute.

The term "monophasic" is herein intended to mean that the candle of our invention on use or when not in use exists in one unitary phase without any phase separation resulting from the inclusion in the gellant-solvent system of a functional composition, e.g. a fragrance composition.

The term "thermally reversible" is herein intended to mean that the candle of our invention retains the original proportions of the constituents of its composition and retains its original physical characteristics and its original dimensions on use thereof, and subsequent to use thereof.

Two alternative preferable embodiments exist for the aforementioned article:

(a) A surfactant-containing candle wherein the gellant-solvent-surfactant/additional solvent system consists essentially of:
  (i) from about 20% to about 70% by weight of said candle of a gellant which is, in the alternative or in combination (A) at least one ester-terminated polyamide and/or (B) at least one tertiary amide-terminated polyamide;
  (ii) from about 15% to about 60% by weight of said candle of a vegetable-based solvent which is, in the alternative or in combination (A) at least one methyl ester of a vegetable-derived $C_{12}$–$C_{18}$ carboxylic acid and/or (B) at least one glyceryl ester of a vegetable-derived $C_{10}$ carboxylic acid; and
  (iii) from about 3% to about 20% by weight of said candle of at least one surfactant having a hydrophile/lipophile balance in the range of from about 3 to about 7, which is, in the alternative, or in combination (hydroxytriethoxy)coconut amine, di(hydroxyethoxy)coconut amine, (hydroxydiethoxy)coconut amine, N(hydroxyethoxy)-N-(hydroxydiethoxy)coconut amine, diethylene glycol mono(nonylphenyl) ether, hydroxytriethoxydodecane and/or hydroxytriethoxytridecane.

(b) A surfactant-free isopropyl myristate-containing candle of wherein the gellant-solvent/additional solvent system consists essentially of:
  (i) from about 20% to about 70% by weight of said candle of a gellant which is, in the alternative or in combination (A) at least one ester-terminated polyamide and/or (B) at least one tertiary amide-terminated polyamide; and
  (ii) from about 15% to about 60% by weight of said candle of a vegetable-based solvent which is, in the alternative or in combination, (A) at least one methyl ester of a vegetable-derived $C_{12}$–$C_{18}$ carboxylic acid and/or (B) at least one glyceryl ester of a vegetable-derived $C_{10}$ carboxylic acid and, admixed therewith, an additional solvent, isopropyl myristate.

In the case where a surfactant is included in the gel matrix body of the candle article of our invention, the candle article of our invention is preferably prepared according to a process herein below, and in the Examples, herein, referred to as "Process α", comprising the steps of:

(a) mixing the gellant, solvent and surfactant at a temperature in the range of from about 95° C. to about 110° C. for a sufficient time to cause the admixture to be a stable single liquid phase;
(b) cooling the resulting gellant-solvent-surfactant system mixture to a temperature in the range of from about 75° C. to about 85° C.;
(c) admixing a system-compatible functional composition with the resulting gellant-solvent-surfactant system mixture thereby forming a functional composition-gellant-solvent-surfactant system mixture;
(d) optionally adding one or more additives such as an antioxidant, a stabilizer, a colorant and/or a flame retardant to the resulting functional composition-gellant-solvent-surfactant system mixture;
(e) placing the resulting mixture into a mold while the resulting mixture is in the liquid phase;
(f) causing at least 1 candle wick to be embedded in the resulting liquid phase mixture; and
(g) cooling the resulting mixture to ambient temperature whereby a candle is formed which may, but need not, have two oppositely-situated substantially parallel horizontally-disposed planar surfaces, each of which is substantially perpendicular and juxtaposed to a substantially vertically-disposed surface.

In the case where the gel matrix includes isopropyl myristate, but may not include a surfactant, the process, herein below and in the Examples, infra, referred to as "Process β" for preparing the candle article of our invention comprises the steps of;

(a) mixing the gellant, solvent and isopropyl myristate at a temperature of about 100° C. for a time period sufficient to cause the admixture to be a stable single liquid phase;
(b) cooling the resulting gellant-solvent-isopropyl myristate system mixture to a temperature of about 90° C.;
(c) admixing a system-compatible functional composition with the gellant-solvent-isopropyl myristate mixture thereby forming a functional composition-gellant-solvent-isopropyl myristate system mixture;
(d) optionally adding one or more additives such as an antioxidant, a stabilizer, a colorant and/or a flame retardant to the resulting mixture;
(e) placing the resulting mixture in a molding while the resulting mixture is in the liquid phase;
(f) causing at least 1 candle wick to be embedded in the resulting liquid phase mixture; and
(g) cooling the resulting mixture to ambient temperature whereby a candle is formed which may, but need not, have two oppositely situated substantially parallel horizontally-disposed planar surfaces, each of which is substantially perpendicular and juxtaposed to a substantially vertically-disposed surface.

In each of the above-mentioned cases, the resulting candle may, if desired, be coated by means of inclusion in the process of our invention, herein below and in the Example, infra, referred to as "Process γ", the following additional steps (h), (i) and (j):

(h) admixing a fatty acid-dimer based polyamide resin with a lower alkanol solvent at a temperature of about 60° C. for a time period sufficient to cause the polyamide resin to be dissolved in said lower alkanol solvent thereby forming a polyamide-lower alkanol solution, wherein the weight ratio of polyamide resin:lower alkanol solvent is from about 2:3 to about 3:2;

(i) coating the resulting solution onto said vertically-disposed surface while maintaining the temperature of the solution at about 60° C.; and (j) cooling the resulting coated candle to ambient temperature.

DETAILED DESCRIPTION OF THE INVENTION

As stated herein, the gellant used in the candle article of our invention is, in the alternative or in combination (A) at least one ester-terminated polyamide or (B) at least one tertiary amide-terminated polyamide.

Preferable ester-terminated polyamides useful in the practice of our invention are those disclosed in U.S. Pat. No. 5,998,570 the disclosure of which is incorporated herein by reference, and include those ester-terminated polyamides prepared by reacting "x" equivalents of a dicarboxylic acid wherein at least 50% of those equivalents are from polymerized fatty acid, "y" equivalents of ethylenediamine and "z" equivalents of an alcohol which is in the alternative, or in combination, cetyl alcohol and/or stearyl alcohol wherein:

$0.9 \leqq \{x/(y+z)\} \leqq 1.1$ and $0.1 \leqq \{z/(y+z)\} \leqq 0.7$.

More preferably, the ester-terminated polyamide is one of a group having a weight-average molecular weight of about 6000 and a softening point in the range of from 88° C. up to 94° C. prepared by reacting "x" equivalents of $C_{36}$ dicarboxylic acid, "y" equivalents of ethylenediamine and "z" equivalents of an alcohol which is, in the alternative or in combination cetyl alcohol and/or stearyl alcohol wherein $0.9 \leqq \{x/(y+z)\} \leqq 1.1$ and $0.1 \leqq \{z/(y+z)\} \leqq 0.7$ as disclosed in Published U.S. Patent Application 2001/0031280 published on Oct. 18, 2001, the specification incorporated herein by reference. Most preferable are the mineral oil-free ester-terminated polyamides, UNICLEAR™ 100 and UNICLEAR™ 100V, Arizona Chemical Company, Panama City, Fla.

Preferable tertiary amide-terminated polyamides useful in the practice of our invention are those disclosed in U.S. Pat. No. 6,268,466, the specification is incorporated herein by reference, and include those tertiary amide-terminated polyamides prepared by reacting "x" equivalents of dicarboxylic acid wherein at least 50% of those equivalents are from polymerized fatty acid, "y" equivalents of ethylenediamine and "z" equivalents of a monofunctional reactant having a secondary amine group as the only reactive functionality wherein $0.9 \leqq \{x/(y+z)\} \leqq 1.1$ and $0.1 \leqq \{z/(y+z)\} \leqq 0.7$. Most preferable are those tertiary amide-terminated polyamides disclosed in Example 1 of U.S. Pat. No. 6,268,466.

The solvents which are useful in the practice of our invention are methyl esters of $C_{12}$–$C_8$ carboxylic acids or glyceryl esters of vegetable-derived $C_{10}$ carboxylic acids. The preferred vegetable-based solvents useful in the practice of our invention are (A) the methyl ester of soy fatty acid, referred to herein as "soybean methyl ester", the soy fatty acid being a mixture containing about 26% oleic acid, about 49% of linoleic acid about 11% of linolenic acid and about 14% of saturated fatty acids, and (B) the tri-glyceride of a mixture of caprylic acid and capric acid, for example the composition marketed under the trademark NEOBEE®-M5, Stepan Chemical Company, Northfield, Ill.

A preferred solvent useful in the practice of our invention is a mixture of soy fatty acid methyl ester and isopropyl myristate with the weight ratio of soy fatty acid methyl ester:isopropyl myristate being from about 2:1 to about 20:1.

When a surfactant is used in the gellant-containing system of the candle article of our invention, such surfactant has a hydrophile/lipophile balance, referred to herein as "HLB", in the range of from about 3 to about 7, and may be in the alternative, or in combination, di(hydroxyethoxy)coconut amine, for example, PEG-2 Cocamine marketed as PROTOX™ C-2, Protameen Chemicals, Inc., Totowa, N.J.; (hydroxy-triethoxy)coconut amine, PEG-3 Cocamine, (hydroxy-diethoxy)coconut amine, N-(hydroxyethoxy)-N-(hydroxydiethoxy)coconut amine, diethylene glycol mono (nonylphenyl)ether, such as, nonoxynol-2 having an HLB=4.6, marketed as IGEPAL® CO-210, Rhone-Poulenc Surfactants and Specialties, L.P., Cranbury, N.J.; hydroxytriethoxydodecane, such as, TOMADOL™ 23-1, Tomah Products, Inc., Milton, Wis. and hydroxytriethoxytridecane.

As stated herein, the candle of our invention includes a system-compatible functional composition, for example, a fragrance composition, an air freshener composition or an insect repellent composition. Each component of such composition preferably has a $Clog_{10}P$ of between 2.5 and 8.0, according to the inequality: $2.5 \leqq Clog_{10}P \leqq 8.0$, wherein the term "$Clog_{10}P$" represents the calculated logarithm to the base 10 of the n-octanol/water partition coefficient of the said component.

The $log_{10}P$ of many perfume ingredients has been reported; for example, the Pomona92 database, available from Daylight Chemical Information Systems, Inc. (Daylight CIS), Irvine, Calif., contains many, along with citations to the original literature. However, the $log_{10}P$ value are most conveniently calculated by the "CLOGP" program, also available from Daylight CIS. This program also lists experimental $log_{10}P$ values when they are available in the Pomona92 database. The "calculated $log_{10}P$" ($Clog_{10}P$) is determined by the fragment approach of Hansch and Leo (cf., A. Leo in Comprehensive Medicinal Chemistry, Vol.4, C. Hansch, P. G. Sammens, J. B. Taylor and C. A. Ramsden, Eds., p.295, Pergamon Press, 1990. The fragment approach is based on the chemical structure of each perfume ingredient, and takes into account the numbers and types of atoms, the atom connectivity and the chemical bonding. The $Clog_{10}P$ value which are the most reliable and widely used estimates for this property, are preferably used instead of the experimental $log_{10}P$ values for the selection of perfume ingredients which are useful in the gel matrix air freshener articles of our invention.

Specific examples of preferred fragrance, air freshener and insect repellant composition components useful in the gellant system of the candle article of our invention is as follows:

| Fragrance Component | $Clog_{10}P$ value |
|---|---|
| α-Terpineol | 2.569 |
| Dihydromyrcenol | 3.03 |
| δ-Undecalactone | 3.830 |
| Benzophenone | 3.120 |
| α-Irone | 3.820 |
| Nerol | 2.649 |
| 6-Phenyl heptanol-2 | 3.478 |
| 1-Phenyl hexanol-5 | 3.299 |
| α-Santalol | 3.800 |
| Iso-eugenol | 2.547 |
| Linalyl acetate | 3.500 |
| Amyl salicylate | 4.601 |
| β-Caryophyllene | 6.333 |
| Cedrol | 4.530 |
| Cedryl acetate | 5.436 |
| Cedryl formate | 5.070 |
| Ethyl undecylenate | 4.888 |
| Geranyl anthranilate | 4.216 |
| Linalyl benzoate | 5.233 |
| Patchouli alcohol | 4.530 |
| 5-Acetyl-1,1,2,3,3,6-hexamethyl indane | 5.977 |
| d-Limonene | 4.232 |
| Cis-p-t-butylcyclohexyl acetate | 4.019 |

The candle article of our invention can, if desired be coated, for example with a fatty acid dimer-based polyamide resin such as UNI-REZ® 2228, Arizona Chemical Company, Jacksonville, Fla. As a further example, the candle article of our invention may be substantially in the shape of an upright cylinder or conical frustum having substantially planar horizontally-disposed upper and lower surfaces, each of which surface is substantially perpendicular to a common substantially vertically-disposed surface juxtaposed to each of said horizontally-disposed surfaces, and the "substantially vertically-disposed surface" is the surface that is preferably coated with the aforementioned fatty acid dimer-based polyamide resin according to the process of our invention as set forth herein and as exemplified infra.

The following non-limiting examples are presented for purposes of illustration:

EXAMPLE A

Preparation of Air Freshener Fragrance for Gellant System of Candle Article

The following fragrance was prepared for use in Part "A" of Examples 1–4, infra:

| Ingredients | Parts by Weight |
|---|---|
| α-Irone | 7.0 |
| Dihydromyrcenol | 4.0 |
| Benzophenone | 3.0 |
| β-Caryophyllene | 2.0 |
| Linalyl acetate | 12.0 |
| Nerol | 7.0 |
| Cedrol | 8.0 |
| Patchouli alcohol | 2.0 |

EXAMPLE B

Preparation of Fragrance for Gellant System of Candle Article

The following fragrance was prepared for use in Examples 5 and 6, herein:

| Ingredients | Parts by Weight |
|---|---|
| Amyl salicylate | 4.0 |
| β-Caryophyllene | 14.0 |
| Cedryl acetate | 16.0 |
| Cyclohexyl salicylate | 4.0 |
| γ-Dodecalactone | 3.0 |
| Geranyl anthranilate | 3.0 |
| α-Irone | 10.0 |

EXAMPLES 1 and 2

Container candles are prepared according to "Process β "described herein:

| Ingredients | Example 1 (Parts by Weight) | Example 2 (Parts by Weight) |
|---|---|---|
| UNICLEAR ® 100 V | 24 | 24 |
| Soy Methyl Ester | 58 | 60 |
| Dipropylene Glycol | 3 | 0 |
| PEG-2 Cocamine | 0 | 0.5 |
| TOMADOL ® 23-1 | 5 | 5 |
| Fragrance of Example A, supra | 5 | 5 |
| Isopropyl myristate | 5 | 5 |
| Hexylene glycol | 0 | 0.5 |

EXAMPLES 3 and 4

Pillar candles are prepared according to "Process α", described herein:

| Ingredient | Example 3 (Parts by Weight) | Example 4 (Parts by Weight) |
|---|---|---|
| UNICLEAR ™ 100 V | 50 | 50 |
| Soy Methyl Ester | 40 | 0 |
| NEOBEE ® M-5 | 0 | 30 |
| IGEPAL ® CO-210 | 12.5 | 12.5 |
| PEG-2 cocamine | 2.5 | 2.5 |
| Fragrance of Example A, supra | 5 | 5 |

Pillar candles are prepared according to "Process β" described herein as modified by "Process γ" as described herein:

| Ingredients | Example 5 (Parts by Weight) | Example 6 (Parts by Weight) |
|---|---|---|
| UNICLEAR ™ 100 V | 50 | 50 |
| Soy Methyl Ester | 40 | 37 |
| Isopropyl Myristate | 5 | 8 |
| Fragrance of Example B, supra | 5 | 5 |

The candles of Examples 5 and 6 were coated with UNI-REZ® 2228 in accordance with the procedure of "Process γ" described herein.

Each of the candles of Examples 1–6, inclusive, showed no syneresis after 30 days. Each of the candles of Examples 1–6 was clear after 30 days. After 30 days, each of the candles was placed in a two ounce glass container and the containers were then stored in a freezer operating at 10° C. for a period of 10 days. None of the candles showed cracks at the end of the 10-day period.

Insect repellent candles were prepared using the same formulations as in Examples 1–6 with the exception that the fragrance formulations of Examples A and B were replaced by insect repellent formulations, containing nerol, citronellol, geraniol, 3,7-dimethyl octanol-1, and β-elemene as described in U.S. Pat. No. 6,255,356, the disclosure of which is incorporated herein by reference. Each of the "insect repellent" candles showed identical effects on storage as the candles of Examples 1–6.

Each of the candles of the aforementioned Examples 1–6, inclusive, can, optionally, contain an "additive" as set forth herein which does not compromise the transparency property of the candle: an antioxidant, a stabilizer, a colorant and/or a flame retardant. An example of a preferred colorant is a thermochromic colorant as disclosed in Hannington et al., Published U.S. Patent Application 2001/0031438 published on Oct. 18, 2001, the specification is incorporated herein by reference. Additional examples of preferred colorants useful in the practice of our invention are disazo dyestuffs as disclosed in U.S. Pat. No. 6,319,290, the specification for which is incorporated herein by reference. The range of use of such colorants is from about 0.01% up to about 0.5% by weight of the candle.

Each of the candles of the aforementioned Examples 1–6, inclusive can contain one or more icons, clear or "main fill" or "overpour" as disclosed in U.S. Pat. No. 6,214,063, cited herein, with the exception than in place of the UNICLEAR™ 80 ETPA shown to be used, for example in Tables 1, 2 and 3 thereof, UNICLEAR™ 100V is used. Other U.S. Patents disclosing icons include U.S. Pat. Nos. 5,679,334; 6,071,506; 6,294,162, 6,309,715, the specification of these patents as well as U.S. Pat. No. 6,214,063 are incorporated herein by reference.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A substantially hydrocarbon-free, substantially stearic acid-free, transparent, syneresis-free candle comprising at least one substantially upright wick partially imbedded in a composition consisting essentially of:

(a) from about 75% by weight of said candle to about 99% by weight of said candle of a gellant-solvent-surfactant/additional solvent system consisting essentially of:

(i) from about 20% to about 70% by weight of said candle of a gellant selected from the group consisting of (A) at least one ester-terminated polyamide; and (B) at least one tertiary amide-terminated polyamide;

(ii) from about 15% up to about 60% by weight of said candle of a solvent selected from the group consisting of (A) at least one methyl ester of a vegetable-derived $C_{12}$–$C_{18}$ carboxylic acid and (B) at least one glyceryl ester of a vegetable-derived $C_{10}$ carboxylic acid and, optionally admixed therewith, an additional solvent selected from the group consisting of dipropylene glycol and isopropyl myristate; and (iii) from about 3% to about 20% by weight of said candle of at least one surfactant having a hydrophile/lipophile balance in the range of from about 3 up to about 7, selected from the group consisting of, di(hydroxyethoxy)coconut amine, (hydroxy-triethoxy)coconut amine, (hydroxy-diethoxy)coconut amine, N-(hydroxyethoxy)-N-(hydroxydiethoxy)coconut amine, hydroxy-triethoxydodecane and hydroxytri-ethoxytridecane;

(b) from about 1% to about 25% by weight of said candle of a system-compatible functional perfume composition; and (c) optionally, one or more additives selected from the group consisting of an antioxidant, a stabilizer, a colorant and a flame retardant.

2. The candle of claim 1 wherein the gellant is an ester-terminated polyamide having a weight-average molecular weight of about 6000 and a softening point in the range of from 88° C. to 94° C. prepared by reacting "x" equivalents of $C_{36}$ dicarboxylic acid, "y" equivalents of ethylenediamine and "z" equivalents of an alcohol selected from the group consisting of cetyl alcohol and stearyl alcohol wherein $0.9 \leqq \{x/(y+z)\} \leqq 1.1$ and $0.1 \leqq \{z/(y+z)\} \leqq 0.7$ and the solvent is a mixture of soy fatty acid methyl ester and isopropyl myristate, the weight ratio of soy fatty acid methyl ester:isopropyl myristate being from about 2:1 to about 20:1.

3. The candle of claim 1 wherein the system-compatible functional perfume composition has a $Clog_{10}P$ of between 2.5 and 8.0, according to the inequality: $2.5 \leqq Clog_{10}P \leqq 8.0$, wherein the term $Clog_{10}P$ represents the calculated logarithm to the base 10 of the n-octanol/water partition coefficient of the said component.

4. The candle of claim 1 substantially in the shape of an upright cylinder or conical frustum having substantially planar horizontally-disposed upper and lower surfaces each of which surface is substantially perpendicular to a common substantially vertically-disposed surface juxtaposed to each of said horizontally-disposed surfaces, said substantially vertically-disposed surface being coated with a fatty acid dimer-based polyamide resin.

5. A process for preparing the candle of claim 1 comprising the steps of:

(a) mixing the gellant, solvent and surfactant at a temperature in the range of from about 95° C. up to about 110° C. for a time period sufficient to cause the admixture to be a stable single liquid phase;

(b) cooling the resulting gellant-solvent-surfactant system mixture to a temperature in the range of from about 75° C. up to about 85° C.;

(c) admixing a system-compatible functional perfume composition with the resulting gellant-solvent-surfactant system mixture thereby forming a functional perfume composition-gellant-solvent-surfactant system mixture;

(d) optionally adding one or more additives to the resulting functional perfume composition-gellant-solvent-surfactant system mixture;

(e) placing the resulting mixture into a mold while the resulting mixture is in the liquid phase;

(f) causing at least 1 candle wick to be embedded in the resulting liquid phase mixture; and (g) cooling the resulting mixture to ambient temperature whereby a candle is formed having two oppositely-situated substantially parallel horizontally-disposed planar surfaces, each of which is substantially perpendicular and juxtaposed to a substantially vertically-disposed surface.

6. A process for preparing the candle of claim 1 comprising the steps of:

(a) mixing the gellant, solvent and isopropyl myristate at a temperature of about 100° C. for a time period sufficient to cause the admixture to be a stable single liquid phase;

(b) cooling the resulting gellant-solvent-isopropyl myristate system mixture to a temperature of about 90° C.;

(c) admixing a system-compatible functional perfume composition with the gellant-solvent-isopropyl myristate mixture thereby forming a functional perfume composition-gellant-solvent-isopropyl myristate system mixture;

(d) optionally adding one or more additives to the resulting mixture;

(e) placing the resulting mixture in a molding while the resulting mixture is in the liquid phase;

(f) causing at least 1 candle wick to be embedded in the resulting liquid phase mixture; and (g) cooling the resulting mixture to ambient temperature whereby a candle is formed having two oppositely situated substantially parallel horizontally-disposed planar surfaces, each of which is substantially perpendicular and juxtaposed to a substantially vertically-disposed surface.

* * * * *